US005921011A

United States Patent [19]

Hawver

[11] Patent Number: 5,921,011

[45] Date of Patent: Jul. 13, 1999

[54] POINT OF PURCHASE DISPLAY

[75] Inventor: James Hawver, Rochester, N.Y.

[73] Assignee: Hawyer, Inc., Rochester, N.Y.

[21] Appl. No.: 08/975,351

[22] Filed: Nov. 20, 1997

[51] Int. Cl.[6] ..... G09F 3/00

[52] U.S. Cl. ..... 40/312; 40/661.08; 248/300; 248/174

[58] Field of Search ..... 40/312, 124.19, 40/661.08, 539, 610; 248/300, 174

[56] References Cited

U.S. PATENT DOCUMENTS

| | | | |
|---|---|---|---|
| 2,762,148 | 8/1956 | Alcaraz . | |
| 2,882,629 | 4/1959 | Moebius . | |
| 2,939,236 | 6/1960 | Stein . | |
| 3,176,419 | 4/1965 | Stein . | |
| 3,292,796 | 12/1966 | Paige | 248/174 |
| 3,322,382 | 5/1967 | Rohrbarch | 248/174 |
| 3,350,804 | 11/1967 | Guyer, Jr. et al. . | |
| 3,470,641 | 10/1969 | Meyer . | |
| 4,738,041 | 4/1988 | Drueck, Jr. . | |
| 5,154,392 | 10/1992 | Voight . | |

*Primary Examiner*—Cassandra H. Davis
*Attorney, Agent, or Firm*—Cumpston & Shaw

[57] ABSTRACT

A point of purchase display for securing a display sign to a side of a box is disclosed. The point of purchase display comprises a holder base having a plurality of foldable sections. Preferably, a middle section and two connecting sections are folded and inserted into a back bone of a display sign. Two end sections and the two connecting sections preferably each comprise a slot which slots are pushed over the side of a box. Thus, each of the end sections and the connecting sections have a portion which pushes against a front of the side of the box and a portion which pushes against a rear of the side of the box for securely retaining the display sign above the box. Preferably, the display sign and the back bone are also made from foldable sections such that the apparatus may be easily shipped for assembly at the designated display area.

18 Claims, 5 Drawing Sheets

POINT OF PURCHASE DISPLAY

FIELD OF THE INVENTION

The present invention relates to display signs, and more particularly to a collapsible display sign having a post and a display sign holder adapted to secure a display sign to a side of a box.

BACKGROUND OF THE INVENTION

Collapsible display signs and posts are typically fabricated from cardboard or similar flexible material. Display signs of this general type are used in merchandising articles in food stores, for example. They must be produced inexpensively and still be attractive in appearance and capable of withstanding rather rough treatment. These signs are often of considerable size when erected, but should be very compact when disassembled for shipping or storage purposes.

When erecting the display sign, it is most desirable to have the sign as close as possible to the merchandise being advertised as possible. U.S. Pat. No. 3,350,804 to Guyer, Jr., et al, discloses a supporting bracket for securing a display sign to a vertical surface by using double faced adhesive strips. This is insufficient for heavy signs, and even lighter signs may eventually fall due to moisture in the environment which diminishes the surface adhesion. U.S. Pat. No. 3,470,641 to Meyer, U.S. Pat. No. 3,176,419 to Stein, and U.S. Pat. No. 4,738,041 to Drueck, Jr. disclose various types of supporting bases for display signs. The supporting bases must sit on a flat surface, and, unless they are made unduly large, pose a risk for tipping their display signs. When the display sign rests on the floor, it takes up valuable floor space, potentially blocks rows of merchandise, and cannot always be placed in the vicinity of the merchandise it is intended to advertise. U.S. Pat. No. 2,882,629 to Moebius, U.S. Pat. No. 2,939,236 to Stein, and U.S. Pat. No. 5,154,392 to Voight disclose display signs which are adapted to be supported by bottles or jugs. While these may provide heavier supporting bases, it is not always convenient or attractive to display a bottle with a display sign.

Thus, there is a need for a display sign which can be securely supported in the vicinity of the merchandise it is advertising. There is further a need for a display sign which can be secured to a box without the use of adhesives. There is further a need for a display sign supporting bracket which can be made inexpensively and can be easily assembled. There is further a need for a display sign supporting bracket which is sturdy when assembled, but which can also lay flat for shipping. There is further a need for a display sign supporting bracket which can be adapted for use with a variety of display posts.

SUMMARY OF THE INVENTION

It is an object of the present invention to provide a display sign which can be supported by a side of a box using a holder base wherein the holder base includes outwardly extending wings having slots for receiving the box side.

It is another object of the present invention to provide a holder base for a display sign with a U-shaped cross-sectional shape for friction fit connection to a post or back bone of the display sign, wherein the connection may include a portion of the base being slidably received into the post.

It is another object of the present invention to taper the upper ends of the holder base for easing insertion of the holder base into the post.

It is a further object of the present invention to provide convoluted slots in a holder base for a display sign to increase a retention force and add further stability to the holder base.

It is a further object of the present invention to provide a holder base having a middle section, two connecting foldable sections, and two end foldable sections wherein each of the connecting and end foldable sections are provided with a slot and have portions which push against the rear of a side wall of a box and push against the front of a side wall of a box.

It is yet another object of the present invention to provide a point of purchase display wherein the connecting sections of the holder base have an upper portion and a lower portion with the upper portion being about half the width of the lower portion such that the upper edge of the lower portion forms a stop for the backbone to abut against.

It is a further object of the present invention to provide a point of purchase display made from three separate parts which can be stamped from a blank of lightweight material, folded into shape, and joined to form the display.

Other objects will in part be obvious and in part appear hereinafter.

In a preferred embodiment of the present invention, the point of purchase display apparatus comprises a display sign, a back bone inserted into apertures of the display sign, and a holder base having a plurality of foldable sections with slots provided in some of the foldable sections for securing the holder base to a side wall of a box. Each of the foldable sections provided with a slot has a portion adapted to push against a rear surface of the side wall and a portion adapted to push against a front surface of the side wall. Some of the slots may be provided with a convoluted periphery for aiding retention of the holder base onto the side wall.

Preferably the holder base has an imperforate middle foldable section, two connecting foldable sections having slots, and two end foldable sections having slots. The middle foldable section and the connecting foldable sections fold to form a substantially U-shaped cross-section and an upper end of the middle foldable section and an upper end of the connecting foldable sections are inserted into the interior section of the back bone.

Each connecting foldable section has an upper portion and a lower portion, the upper portion of each connecting foldable section being approximately half the width of the lower portion. Thus, an upper edge of the lower portion defines a stop for abutting against a lower edge of the back bone. An upper edge of the upper portions of each connecting foldable section may be tapered to ease insertion of the holder base into the interior section of the back bone. In addition, the width of the middle foldable section is preferably substantially the same as a width of one side of the backbone so that the backbone is held securely on the holder base.

Each of the display sign, backbone, and holder base is preferably stamped from a blank of lightweight foldable material and cut and scored with fold lines prior to assembly. To display the display sign on a side wall of a box, a method is disclosed comprising the steps of providing a display sign with apertures, inserting the back bone through the apertures of the display sign, inserting a substantially U-shaped section of the holder base into an interior section of the back bone, sliding the back bone over the substantially U-shaped section and abutting the back bone with a stop on the holder base, aligning slots in the holder base with a side wall of the box, and pushing the holder base downwardly until a top edge of the side wall abuts with an end of each slot in the holder base.

The foregoing and other features and advantages of the invention will be more readily understood and fully appreciated from the following detailed description, taken in conjunction with the accompanying drawings.

DETAILED DESCRIPTION OF THE PREFERRED EMBODIMENTS

Figure 1:
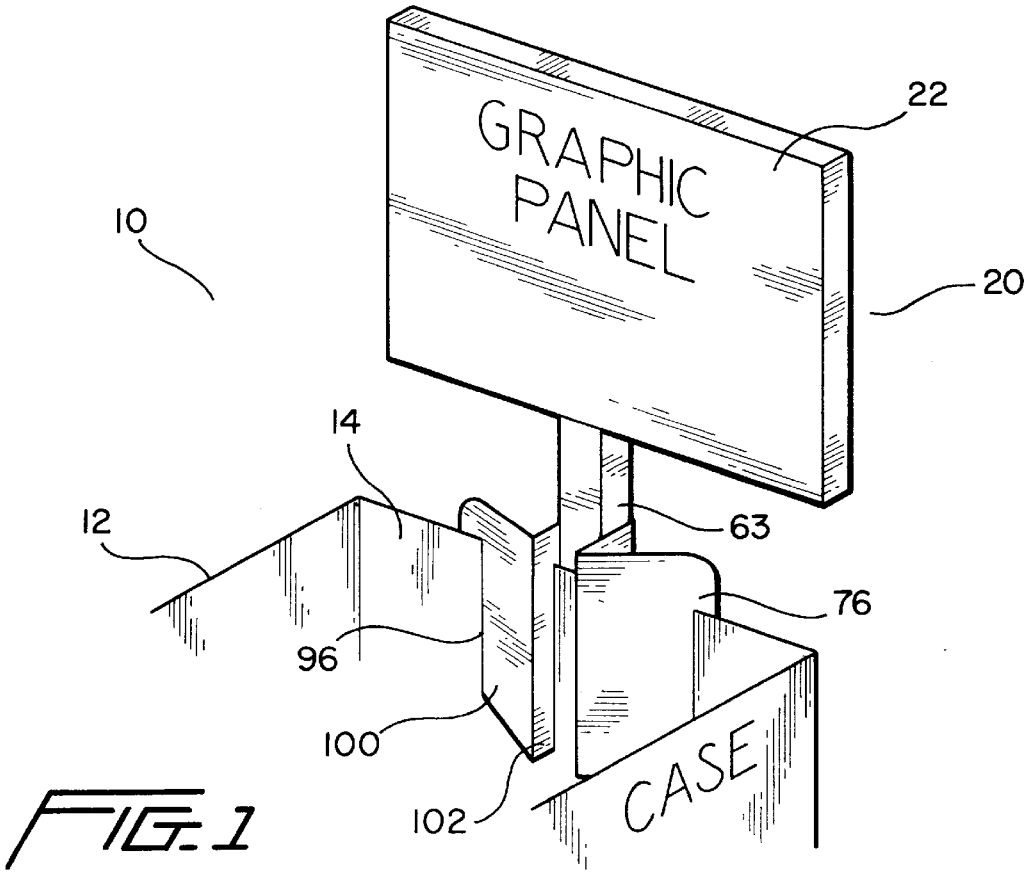
FIG. 1 shows a front perspective view of the point of purchase display of the present invention mounted on a side of a box.

As shown in FIG. 1, a preferred embodiment of the present invention comprises a point of purchase display apparatus 10 which is securable to a side of a box or case 12. The box 12 may contain any type of merchandise for sale or display. The display apparatus 10 preferably comprises a display sign 20, a back bone 63, and a holder base 76.

A front side 22 of the display sign 20 may comprise graphics preprinted before shipment of the display apparatus 10 to the merchandiser, or may be left blank for a store owner to inscribe any desired indicia upon the display sign 20. The display apparatus 10 is preferably positioned on a rear side wall 14 of the box or case 12 so that the front side 22 of the display sign 20 faces shoppers. This way, the merchandise in the box or case 12 is not hidden by the display sign 20, and the indicia on the display sign 20 is directly above the merchandise in the box 12. Alternatively, if there is no merchandise in the case 12 and a store owner merely wishes to use the display apparatus 10 for signage, then the display apparatus 10 could be placed on any side wall of a box or case 12 as desired.

Figure 2:
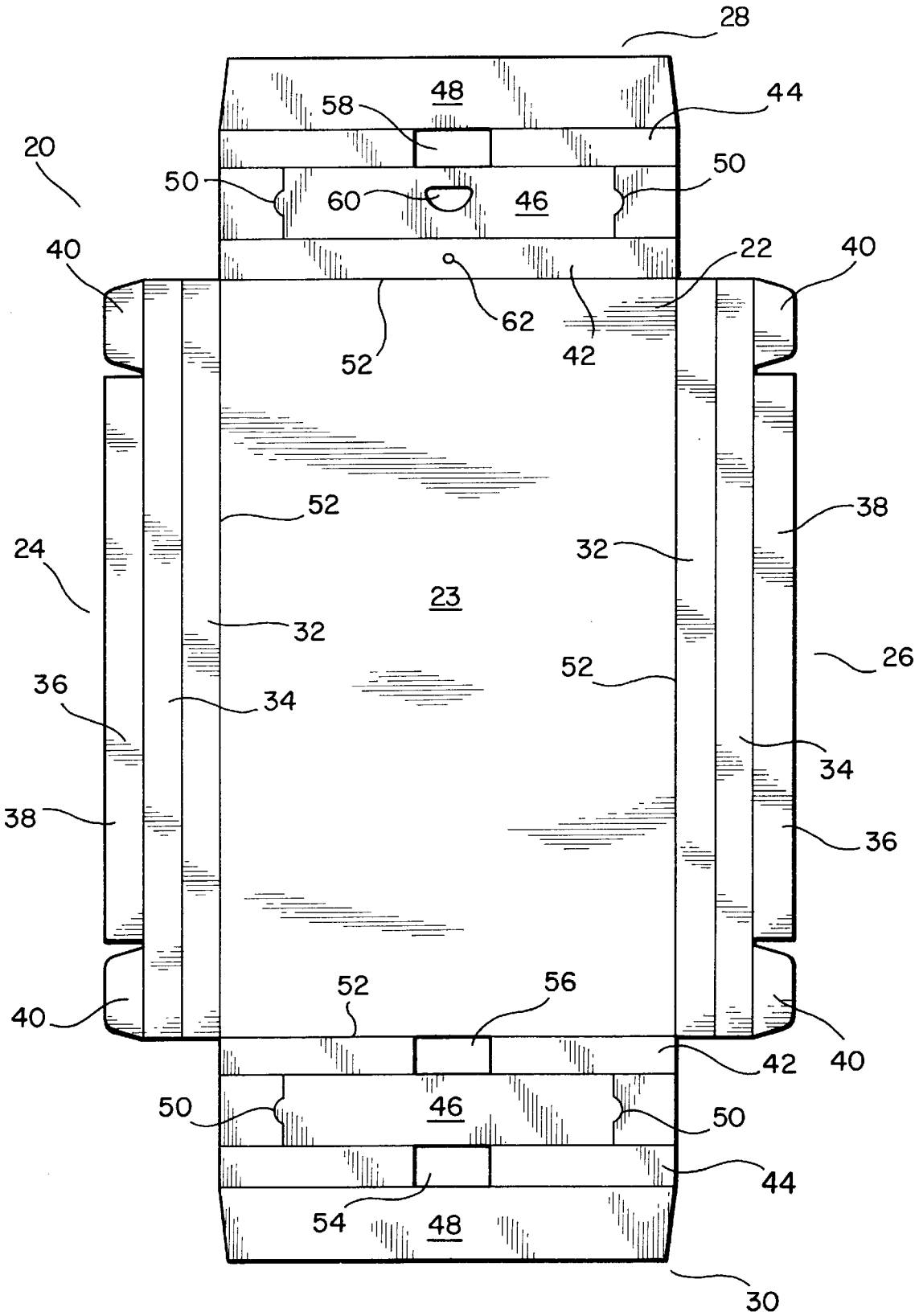
FIG. 2 shows a top plan view of an unfolded display sign for use with the point of purchase display of the present invention.

FIG. 2 shows the display sign 20 in a fully disassembled and unfolded position and as cut and scored from a sheet of stock. The display sign 20 is preferably fabricated from lightweight cardboard stock, which is exceptionally rigid when in the assembled position. Although lightweight cardboard stock is disclosed, it is to be understood that any suitable material is within the scope of this invention, for example, but not limited to, fiber board, plastic, and even potentially metal.

The display sign 20 has a main interior section 23 and is flanked by two tabbed sides, 24 and 26, and two slotted sides 28 and 30. Although the tabbed sides 24 and 26 are shown as being the long sides of a rectangle, it should be understood that the tabbed sides could be the shorter sides of a rectangle, or the display sign could be a square. Each of the tabbed sides 24 and 26 comprise an inner fold section 32, an outer fold section 34, and an exterior tabbed section 36. The tabbed section 36 comprises a middle section 38, and two exterior tabs 40. The slotted sides 28 and 30 each comprise an inner fold section 42 and a middle fold section 44. The inner and middle fold sections 42 and 44 are separated by a slotted section 46. The slotted sides 28 and 30 further comprise an outer fold section 48. The slotted sections 46 each are provided with two slots 50 for receiving the tabs 40 as will be explained.

Figure 3A:
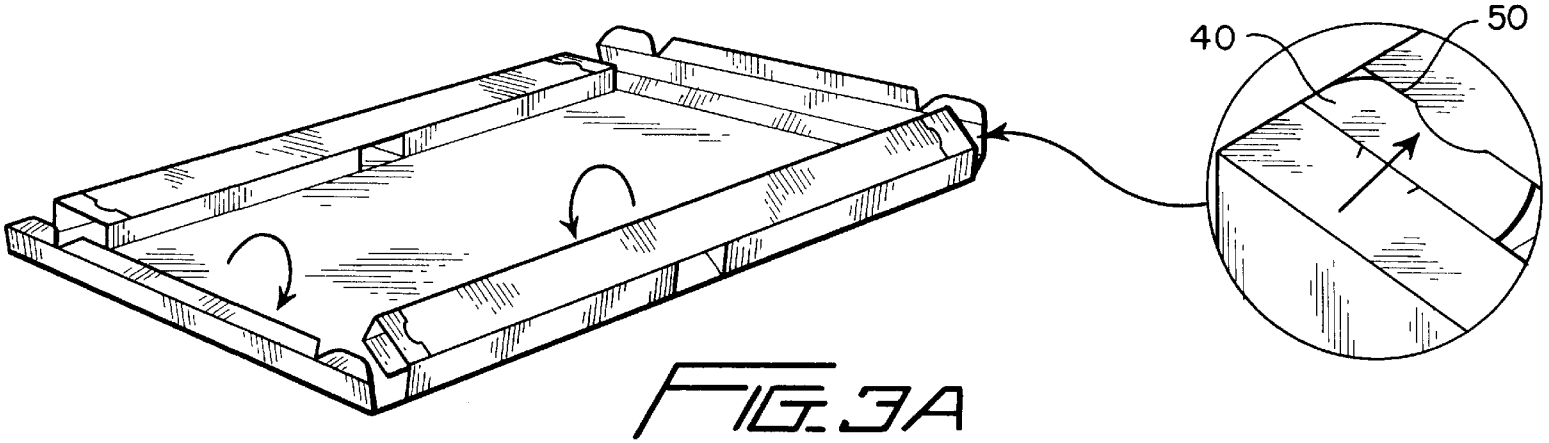
FIG. 3 shows a perspective view of the display sign of FIG. 2 being folded into assembly for use with the point of purchase display of the present invention.
Figure 3B:
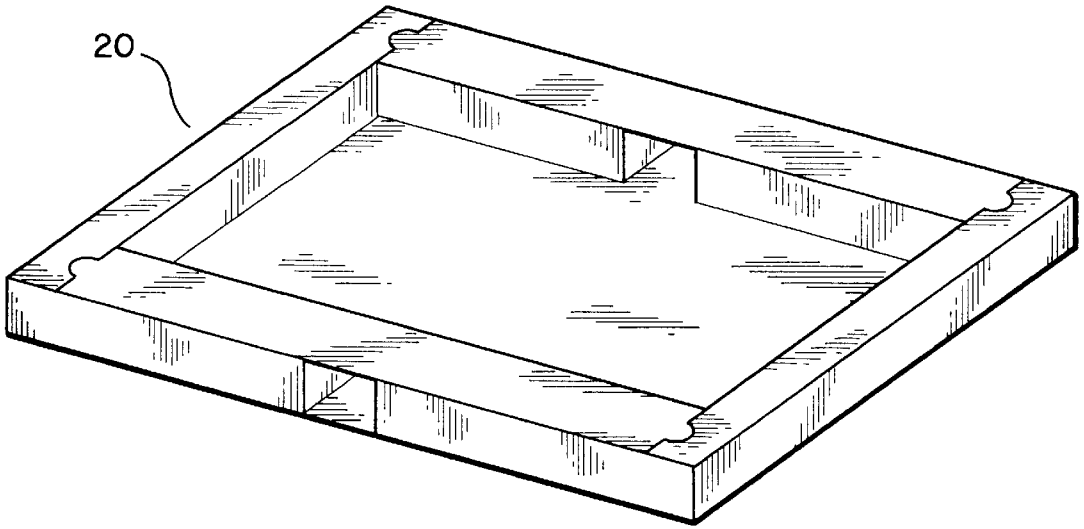

Each of the sections are separated by fold lines for folding the display sign 20 into its assembled configuration. The fold lines may be scored for easy folding. When assembling the display sign, as shown in FIG. 3A, the slotted sides 28 and 30 are preferably folded such that each of the sections 42, 46, 44, and 48 are at right angles to each other, with sections 42 and 44 being parallel to each other and sections 48 and 46 being parallel to each other. Sections 48 lie flat against the rear surface 21 of main interior section 23. Next, the tabbed sides 24 and 26 are preferably folded such that section 36 is at a right angle to section 34 and section 34 is at a right angle to section 32, making sections 36 and 32 parallel. Once the slotted and tabbed sides are folded as described, the tabs 40 of the tabbed sides 24 and 26 are ready to be inserted into the slots 50 of the slotted sides 28 and 30. Tabs 40 may be bent along the fold line for easy insertion into the slots 50. Thus, an assembled display sign 20 as shown in FIG. 3B is shown.

If desired, the display sign 20 may be provided with a small aperture 62 within the inner fold section 42 so that the sign 20 may be hung from the ceiling, such as with a string passing through the hole. Also, a somewhat larger aperture 60 may be provided in the slotted section 46 so that the sign 20 may be hung on a hook or nail on a wall. Although the present invention is fully accomplished when the sign 20 is employed with the back bone 63, the additional apertures 60 and 62 provide the merchandiser with alternative options for displaying the display sign 20 if a box or case 12 is not available.

Figure 4:
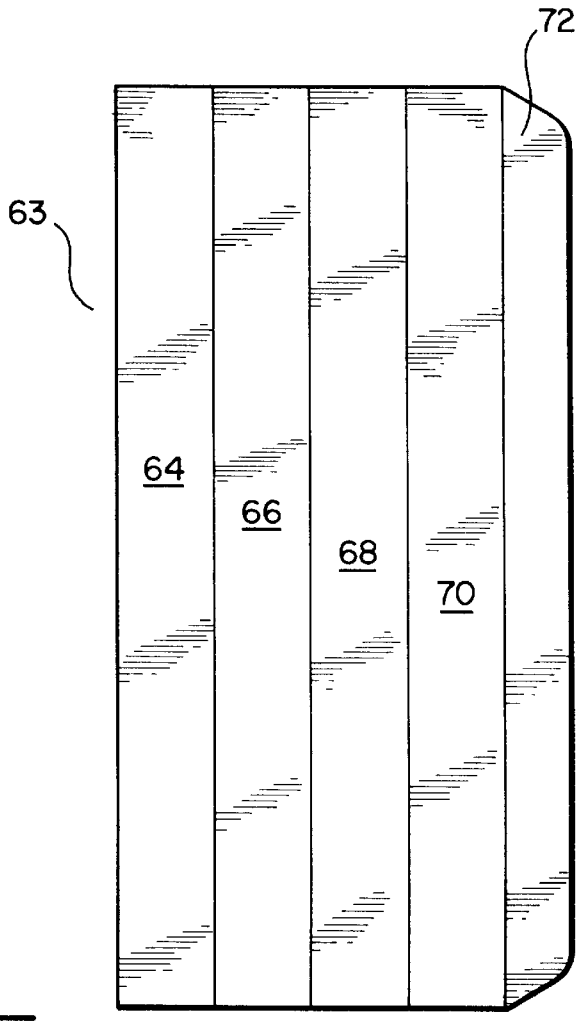
FIG. 4 shows a top plan view of an unfolded back bone for use with the point of purchase display of the present invention.

FIG. 4 shows a backbone 63 that may be used in the display apparatus 10 of the present invention. The backbone 63 is shown in a fully disassembled and unfolded position and as cut and scored from a sheet of stock, preferably fabricated from the same material as the display sign 20, and preferably lightweight cardboard stock, which is exceptionally rigid when in the assembled position.

Figure 5:
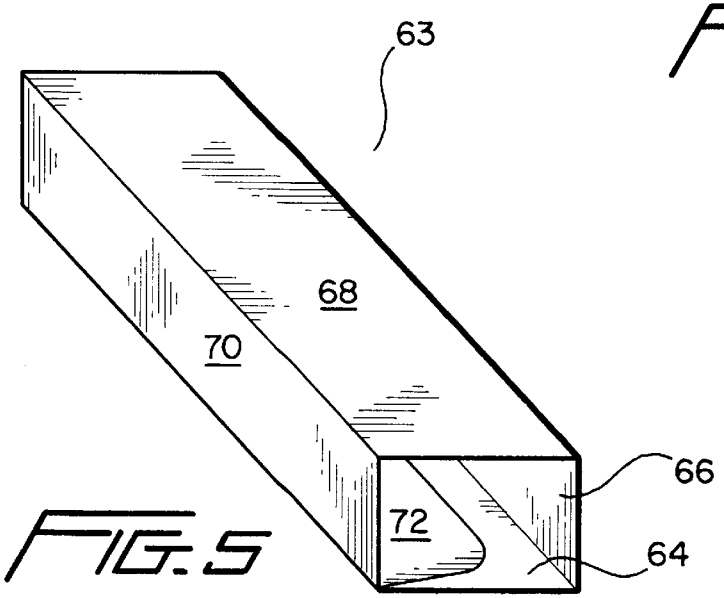
FIG. 5 shows a perspective view of the back bone of FIG. 4 folded into an assembled configuration for use with the point of purchase display of the present invention.

The backbone 63 may be comprised of four side sections, 64, 66, 68, and 70 which comprise the four sides of the backbone 63 having a rectangular, or potentially square, cross-section. A glue section 72 is preferably included for securing the backbone 63 into its rectangular cross-section. Each of the sections are separated by fold lines for folding the backbone 63 into its assembled configuration. The fold lines may be scored for easy folding. As shown in FIG. 5, when assembling the backbone 63, side section 64 is folded at a right angle to side section 66, side section 66 is folded at a right angle to side section 68, side section 68 is folded at a right angle to side section 70, and glue section 72 is folded at a right angle to side section 70 and glued to side section 64. Thus, side section 64 and glue section 72 are parallel to side section 68, and side section 66 is parallel to side section 70.

Figure 6:
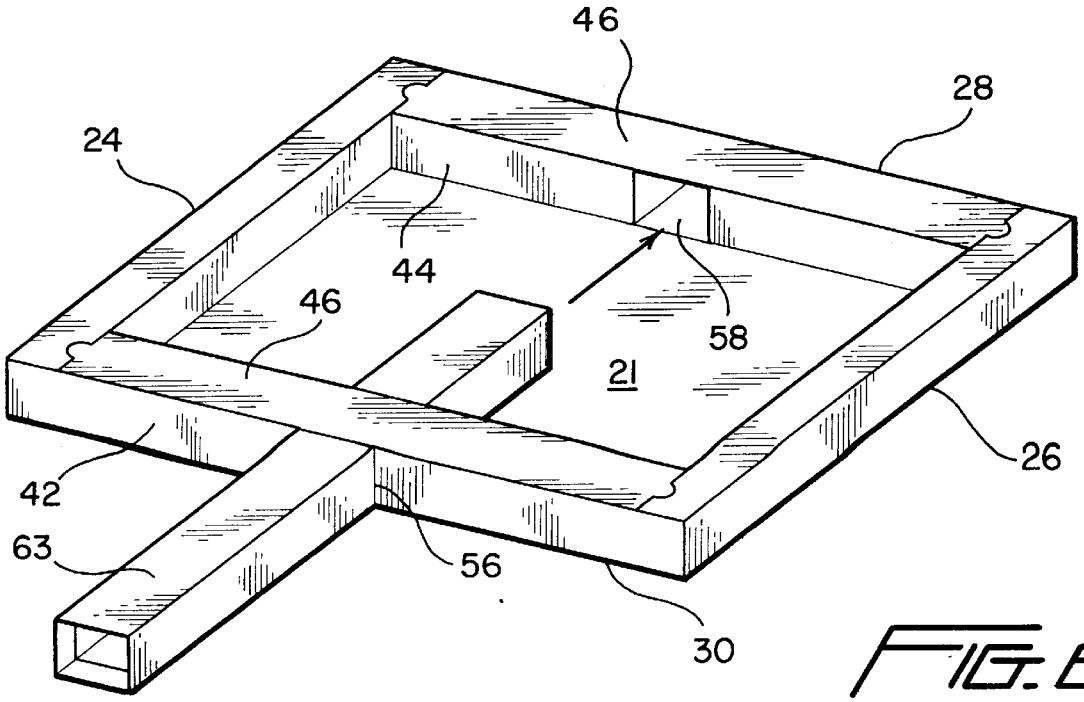
FIG. 6 shows a perspective view of the assembled back bone of FIG. 5 being inserted into the assembled display sign of FIG. 3B.

Turning back to FIG. 2, slotted sides 28 and 30 are preferably formed with openings 54, 56, and 58, which, as will be described, are for receiving the backbone 63. The openings 54, 56, and 58 may be directly cut from the material of the display sign 20 when it is being stamped, or, alternatively, the peripheries of the openings may be provided with perforated score lines such that the interiors of the peripheries may be punched out to form the openings 54, 56, and 58 upon assembly. When the display sign 20 is assembled as described above, opening 56 on inner fold section 42 of slotted side 30 and opening 54 on middle fold section 44 of slotted side 30 are aligned such that the back bone 63 may be inserted first through opening 56 and then through opening 54, as shown in FIG. 6. Then, the back bone is pushed along rear surface 21 of main interior section 36 until it can be inserted through opening 58 on middle fold section 44 of slotted side 28. Preferably, inner fold section 42 is not provided with an opening large enough to allow the back bone to slide through. This way, when the display sign 20 is positioned vertically (with respect to a floor), the top of the back bone rests against the inner fold section 42 of slotted side 28. The back bone 63 thus supports the display sign 20 above the holder base 76 and the lack of a back bone opening in inner fold section 42 of slotted side 28 prevents the display sign 20 from sliding down the back bone 63.

Figure 7:
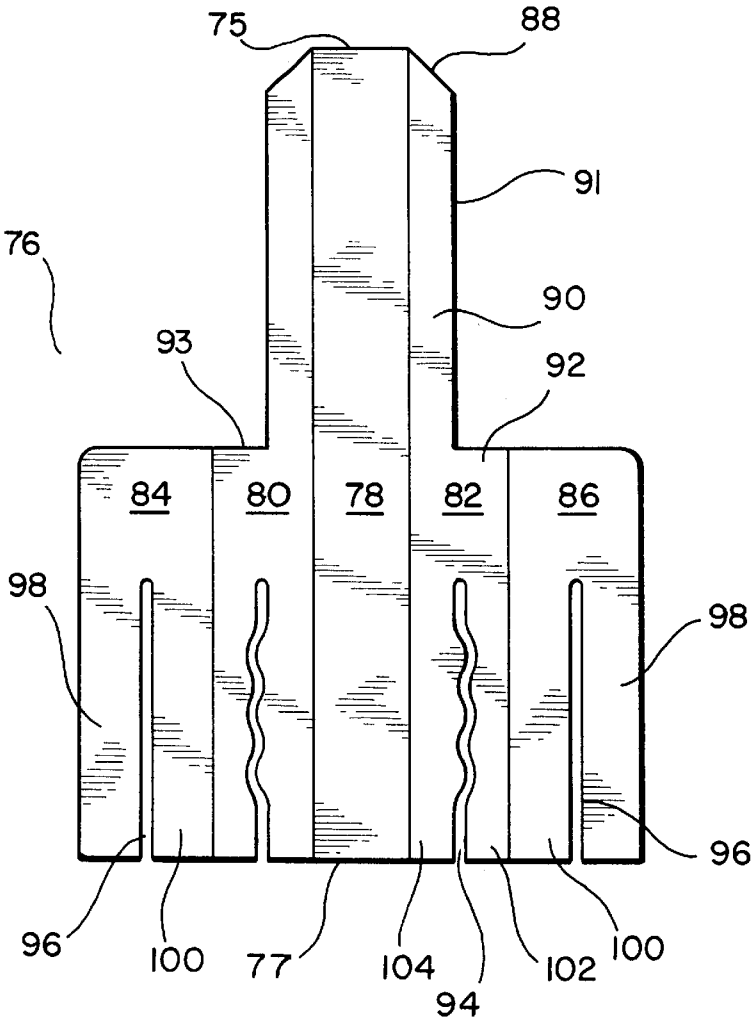
FIG. 7 shows a top plan view of an unfolded holder base for use with the point of purchase display of the present invention.

In order to support the display apparatus 10 on the side of a box or case 12 as shown in FIG. 1, a holder base 76 is preferably provided as shown in FIG. 7. FIG. 7 shows the holder base 76 in a fully disassembled and unfolded position and as cut and scored from a sheet of stock, preferably fabricated from a rigid cardboard stock, preferably thicker than the lightweight cardboard stock that is used for the display sign 20.

The holder base 76 has a top end 75 and a bottom end 77. The holder base 76 preferably comprises five foldable sections, a middle section 78, two preferably substantially identical end sections or wings 84 and 86, and two preferably substantially identical connecting sections 80 and 82. The sections are preferably separated from one another by fold lines created when the blank of cardboard is cut and scored. Each fold line essentially comprises a hinge line, i.e. a living hinge, which connects two adjacent foldable sections. The middle section 78 is preferably an uninterrupted rectangular section having a width sized to fit within the backbone 63. Connecting sections 80 and 82 flank the middle section 78 along its length. Each connecting section may comprise an upper section 90 and a lower section 92. The upper section 90 may be provided with a tapered edge 88 for easier insertion of the holder base 76 into the back bone 63 as will be described. The lower section 92 includes a slot 94 which extends from the bottom 77 of the holder base 76 and which may be wavy as shown. The slots 94 are preferably aligned with the outside edge 91 of the upper section 90 of each connecting section 82. The location of these slots aligns the back bone 63 above the side wall of the box 12. If the slots were closer to the end sections 84 and 86, then the back bone 63 may be positioned too far behind the side wall and may be at risk for tipping.

End sections 84 and 86 flank the connecting sections 80 and 82, respectively, along the length of the lower sections 92. The height of each end section is preferably the same as the height of the lower sections 92 of the connecting sections 80 and 82. This simplifies the shape that needs to be stamped, and gives the overall appearance of the holder base 76 a smooth edge. The comers of the end sections may also be rounded to prevent injury as well as to add to the appearance. Each end section comprises a slot 96 which may be straight as shown, or which may be wavy like slots 94.

Figure 8:
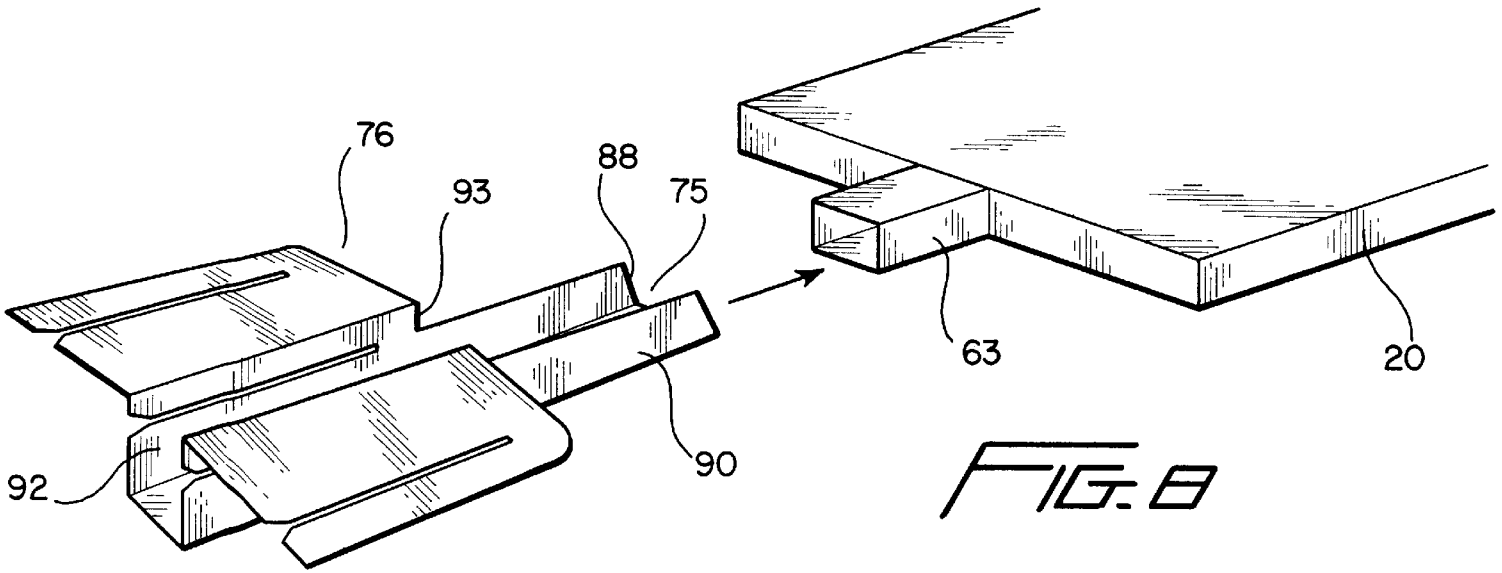
FIG. 8 shows a perspective view of a folded holder base being inserted into a back bone of a display sign for the point of purchase display of the present invention.

Assembling the holder base 76 from its flat unassembled configuration shown in FIG. 7 to its assembled configuration shown in FIG. 8 merely comprises the steps of folding the connecting sections 80 and 82 at angles to the middle section 78 to form a channel having a generally U-shaped cross-section and folding the end sections 84 and 86 at angles to the connecting sections 80 and 82, respectively, to look like wings as shown in FIG. 8. It should be understood that the specific angles between the foldable sections are changeable at any time and can conform easily to the back bone 63 and the side wall of a box 12 being used. Also as shown in FIG. 8, the holder base 76 may be inserted directly into the back bone 63. This is done by sliding the top end 75 of the holder base 76 into the assembled back bone 63. Due to the tapered edges 88, and the ability to fold the upper ends 90 of the connecting sections 80 and 82 inwardly, the insertion into the back bone 63 is made simple. The holder base 76 is inserted into the back bone 63 until the back bone 63 abuts with a top edge 93 of the lower sections 92 of the connecting sections 80 and 82. The top edge 93 prevents the back bone 63 from sliding further down the holder base 76.

Figure 9:
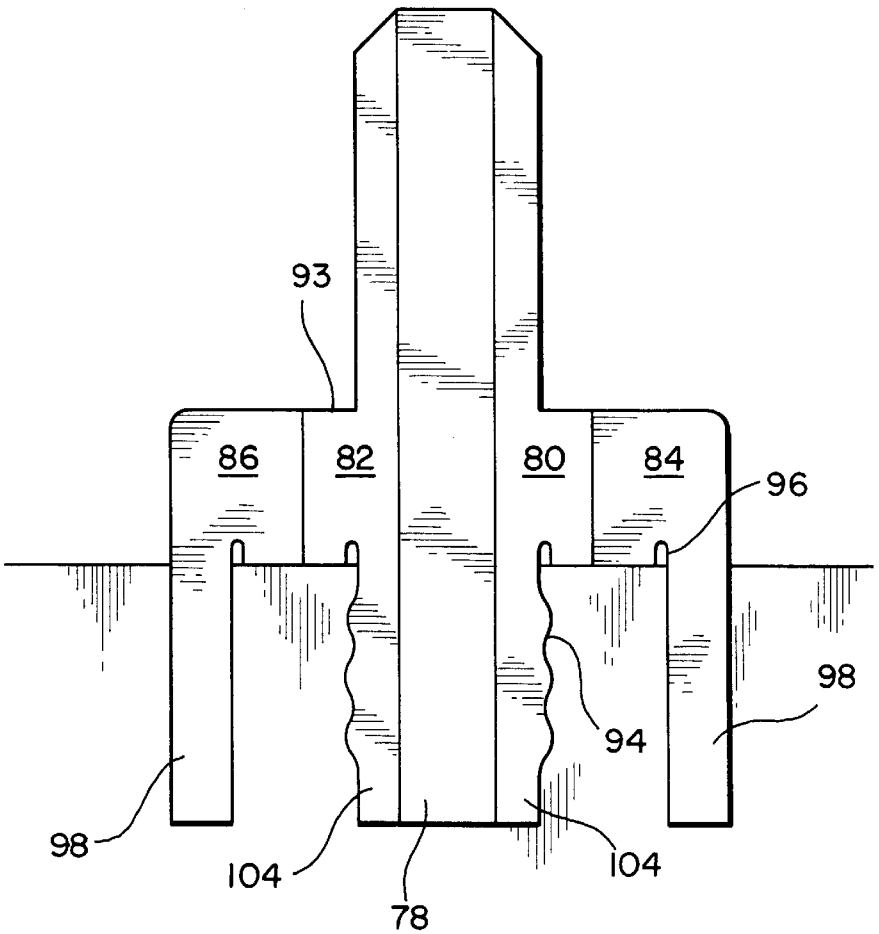
FIG. 9 shows a rear view of the assembled point of purchase display of the present invention mounted on a side of a box.

Alternatively, instead of first attaching the holder base 76 to the back bone 63, the holder base 76 may be attached to the side of a box 12 and then the back bone 63 may be inserted over the holder base 76 to form the point of purchase display 10. Either way, the holder base 76 is attached to the side of a box 12 as shown in FIGS. 1 and 9, where FIG. 1 shows the front of the holder base 76 with the back bone 63 and display sign 20 attached and FIG. 9 shows the rear of the holder base 76 without the remainder of the point of purchase display 10 attached. However, it is understood, the upper portions 90 of at least connecting sections 80, 82 may be configured to slidably receive a length of the back bone 63. That is, while the drawings show the back bone 63 sized to slidably receive the upper portion of the holder base 76, the holder base may be configured to encompass a length of the back bone 63.

Turning to FIG. 1, the slots 94 in the connecting sections 80 and 82 are pushed over the side wall of the box 12 such that only the outer sides 102 of the connecting sections 80 and 82 are visible from the front. At relatively the same time, the slots 96 of the end sections 84 and 86 are pushed over the same side wall of the box 12 such that only the inner sides 100 of the end sections 84 and 86 are visible from the front. From the rear, as shown in FIG. 9, the outer sides 98 of the end sections 84 and 86, the inner sides 104 of the connecting sections 80 and 82, and the middle section 78 all remain visible. Thus, each of the connecting sections and the end sections 80, 82, 84, and 86 are provided with a portion pushing against the front of the side wall and a portion pushing against the back of the side wall. In addition, the length of each section of the holder base 76 is sufficient to securely hug the base onto the side wall of a box 12.

Although, as shown in FIG. 9, the holder base 76 looks fairly spread out along the side wall, once the back bone 63 is pushed over the upper end 75 of the holder base 76, the connecting sections 80 and 82 are pushed closer together thus compacting the remainder of the holder base 76. In the case of a rectangular or square back bone 63, the connecting sections 80 and 82 will be pushed at substantially right angles to the middle section 78 and will be substantially perpendicular to the side wall of the box. Thus, the slots 94 are preferably provided with a wavy profile to more securely stabilize the connecting sections 80 and 82 to the side wall. Because the end sections 84 and 86 are held at a larger angle relative the side wall, a simple straight slot 96 is sufficient, although a wavy profile could be employed if desired.

If mailing the display apparatus 10 to a store owner, merchandiser, or other customer, the display sign 20 could be folded along inner fold lines 52 which surround the main interior section 23 such that tabbed sides 24 and 26 and slotted sides 28 and 30 are positioned within the periphery of the main interior section 23. The back bone 63 could be assembled as shown in FIG. 5 and then pressed flat, and folded in half length-wise, if necessary. The holder base 76 could simply be shipped as shown in FIG. 7. With all items lying flat, the display apparatus 10 could easily be put in a large envelope for shipping.

Thus, it is apparent that there has been provided, in accordance with the invention, a point of purchase display that fully satisfies the objects and advantages set forth above. The point of purchase display is capable of being directly attached to a side of a box without the use of adhesives and in a sturdy and space-saving manner. While the invention has been described in conjunction with specific embodiments thereof, it is evident that many alternatives, modifications, and variations will be apparent to those skilled in the art in light of the foregoing description. For example, a back bone with a circular cross-section could also be used as long as the upper end of the holder base is sized to fit snugly within the back bone. Also, although only five foldable sections have been disclosed, it would be possible to include additional foldable sections with additional slots for further stability. Accordingly, the present invention is intended to embrace all such alternatives, modifications, and variations as fall within the spirit and broad scope of the appended claims.

What is claimed is:

1. A point of purchase display apparatus for supporting a display sign above a box, the display apparatus comprising:

a holder base having an imperforate middle foldable section, two connecting foldable sections having slots, and two end foldable sections having slots, the slots adapted to secure the holder base to a side wall of a box, wherein the middle foldable section and the connecting foldable sections fold to form a substantially U-shaped cross-section, and further wherein an upper end of some of the foldable sections are adapted to be inserted into an interior section of a back bone of a display sign.

2. The point of purchase display apparatus of claim 1 wherein each of the foldable sections provided with a slot has a portion adapted to push against a rear surface of the side wall and a portion adapted to push against a front surface of the side wall.

3. The point of purchase display apparatus of claim 1 wherein the foldable sections are connected together by living hinges.

4. The point of purchase display apparatus of claim 1 further comprising the back bone of a display sign wherein an upper end of the middle foldable section and an upper end of each of the connecting foldable sections are inserted into the interior section of the back bone.

5. The point of purchase display apparatus of claim 4 wherein each connecting foldable section has an upper portion and a lower portion, the upper portion of each connecting foldable section being approximately half the width of the lower portion, wherein an upper edge of the lower portion defines a stop for abutting against a lower edge of the back bone.

6. The point of purchase display apparatus of claim 5 wherein an upper edge of the upper portions of each connecting foldable section is tapered to ease insertion of the holder base into the interior section of the back bone.

7. The point of purchase display apparatus of claim 5 wherein each end foldable section has a height substantially equal to a height of the lower portion of each connecting foldable section.

8. The point of purchase display apparatus of claim 1 further comprising, in combination, the display sign and the back bone, the back bone adapted to be inserted into apertures of the display sign, wherein each of the display sign, backbone, and holder base is stamped from a blank of lightweight foldable material and cut and scored with fold lines prior to assembly.

9. The point of purchase display apparatus of claim 1 wherein each end foldable section is attached to one of the connecting foldable sections.

10. The point of purchase display apparatus of claim 4 wherein the width of the middle foldable section is substantially the same as a width of one side of the backbone.

11. A supporting base for a display comprising:

a channel section having a cross-sectional shape including a first side, a bottom and a second side;

first and second slots in the first side and second side, respectively, for attaching the supporting base to a side wall of a box;

two fold lines between the first and second slots, the bottom of the channel section lying between the two fold lines; and, a first wing and second wing extending outwardly from the first and second sides, respectively, wherein each wing has a slot for attaching the supporting base to a side wall of a box.

12. The supporting base of claim 11 wherein at least one of the slots in the first side, second side, first wing, and second wing has a convoluted periphery.

13. The supporting base of claim 11 wherein each wing is substantially shorter in height than a height of the bottom of the channel section.

14. The supporting base of claim 13 wherein the first side and the second side of the channel section each comprises an upper portion and a lower portion, the upper portion of each side being approximately half the width of the lower portion, wherein an upper edge of the lower portion defines a ledge.

15. The supporting base of claim 14 wherein an upper edge of the upper portion of each side is tapered.

16. The supporting base of claim 14 wherein the slot in each side of the channel section is substantially aligned with an edge of the upper portion of each side of the channel section.

17. The supporting base of claim 11 wherein the supporting base comprises a unitary piece of material stamped from a blank of material.

18. A method of displaying a display sign on a side wall of a box comprising:

providing a display sign with apertures;

inserting a back bone through the apertures of the display sign;

inserting a substantially U-shaped section of a holder base into an interior section of the back bone;

sliding the back bone over the substantially U-shaped section and abutting the back bone with a stop on the holder base;

aligning slots in the holder base with a side wall of the box; and, pushing the holder base downwardly until a top edge of the side wall abuts with an end of each slot in the holder base.

* * * * *

UNITED STATES PATENT AND TRADEMARK OFFICE

CERTIFICATE OF CORRECTION

PATENT NO. : 5,921,011
DATED : July 13, 1999
INVENTOR(S) : Hawver, James

It is certified that error appears in the above-identified patent and that said Letters Patent is hereby corrected as shown below:

Title page,
Item [73], Assignee, name reading "Hawyer, Inc.,", should read as -- Hawver, Inc., --.

Signed and Sealed this

Twentieth Day of May, 2003

JAMES E. ROGAN
*Director of the United States Patent and Trademark Office*